United States Patent [19]

Adamowski et al.

[11] 4,425,296

[45] Jan. 10, 1984

[54] PROBE-HOLDING APPARATUS FOR HOLDING A PROBE FOR CHECKING STEAM GENERATOR TUBES PARTICULARLY IN A NUCLEAR REACTOR INSTALLATION

[75] Inventors: André Adamowski, Paris; Gérard Gallet, Juvisy sur Orge; Jacques Lhermitte, Vertheuil; Maxime Monne, Paris; Guy Vautherot, Gagny, all of France

[73] Assignee: Intercontrole, Rungis, France

[21] Appl. No.: 202,748

[22] Filed: Oct. 31, 1980

[30] Foreign Application Priority Data

Nov. 30, 1979 [FR] France ..... 79 30022

[51] Int. Cl.[3] ..... G21C 17/00

[52] U.S. Cl. ..... 376/245; 376/250; 165/11 A

[58] Field of Search ..... 376/245, 249, 250; 165/11 R, 11 A

[56] References Cited

U.S. PATENT DOCUMENTS 3,954,136 5/1976 Gugel ..... 376/250
4,117,733 10/1978 Gugel ..... 376/249
4,131,018 12/1978 Muller et al. ..... 376/249
4,298,054 11/1984 Adamowski ..... 376/245

FOREIGN PATENT DOCUMENTS 2831822 7/1979 Fed. Rep. of Germany ... 165/11 A
2309314 12/1976 France ..... 376/245

*Primary Examiner*—Sal Cangialosi
*Attorney, Agent, or Firm*—Karl F. Ross; Herbert Dubno

[57] ABSTRACT

Probe-holding apparatus for holding a probe for checking steam generator tubes particularly in a nuclear reactor installation. The apparatus comprises a telescopic arm supported via a ball and socket joint from a support mounted in or near an access aperture in a chamber at one end of the steam generator. A probe guide is carried by a carriage pivotally mounted at the other end of the telescopic arm. The carriage includes an endless belt having a series of spaced projections which engage into the ends of the tubes, the projections being spaced by a distance equal to the tube pitch or a multiple thereof. The belt is driven by a stepping motor in order to move the carriage and place the probe guide opposite different ones of the tubes.

5 Claims, 4 Drawing Figures

PROBE-HOLDING APPARATUS FOR HOLDING A PROBE FOR CHECKING STEAM GENERATOR TUBES PARTICULARLY IN A NUCLEAR REACTOR INSTALLATION

FIELD OF THE INVENTION

The present invention relates to probe-holding apparatus for a probe for checking steam generator tubes.

BACKGROUND OF THE INVENTION

It is necessary for the water tubes of vertical steam generators used in nuclear power plants to be periodically checked. In this respect, the water constituting the primary fluid and contaminated by the nuclear reactions must not be able to pass into the secondary fluid which is used for operating a turbo-alternator. This check is made with the aid of a Foucault current probe which is passed through each of the tubes. A slit or hole in the tube or even a simple reduction in its thickness is then converted into a variation in the output current from the probe.

In practice, the probe is carried by an apparatus mounted movably in the lower chamber of the generator, into which all the tubes open. This apparatus carries a guide tube which is brought in front of a tube of the bundle and into which the probe is inserted. After checking a tube, the probe is withdrawn from the tube, the apparatus is moved through a distance equal to the distance between two tubes, and the probe is inserted into a new tube. These various operations are controlled from the outside because as the chamber wall has been in contact with irradiated water, it itself emits ionizing radiation. The probe-holding apparatus proposed hitherto comprises expansible mandrels which are inserted and fixed into the tubes of the bundle. However, with such apparatus, it is often difficult to check those tubes disposed at the bundle periphery. Moreover, any given apparatus is suitable only for checking tubes which are a given distance apart. If it is required to check the tubes of a steam generator in which the tube pitch is different, the apparatus has to be considerably modified. Finally, such apparatus is large and bulky.

OBJECT OF THE INVENTION

An object of the present invention is to provide a probe-holding apparatus for checking steam generator tubes, which does not have these drawbacks.

SUMMARY OF THE INVENTION

According to the invention, there is provided a probe-holding apparatus for a probe for checking steam generator tubes, said apparatus comprising a telescopic arm resiliently urged towards its position of maximum extension and said arm having first and second opposed ends, a support, joint means movably mounting the first end of the arm on the support, and a carriage hinged to the second end of the arm, said carriage comprising guide means for a probe, drive means, and a stepping motor for driving the drive means, said drive means including spaced projections, the guide means for the probe and the projections being disposed in the same direction, and the projections being spaced apart from each other by a distance related to the pitch of the generator tubes.

Further according to the invention, there is provided a probe-holding apparatus for a probe for checking steam generator tubes, said apparatus comprising a telescopic arm having first and second opposed ends, support means, said first end being pivotally mounted on the support means, and a carriage mounted on the second of said ends, said carriage comprising guide means for the probe, an endless drive member, an array of projections spaced along the drive member in the direction of drive and engageable in the ends of the tubes, and stepping motor means for driving the drive member.

Having placed the apparatus in one of the end chambers of the steam generator, the probe-holding carriage is kept resting by the arm against the tube plate located in this chamber, the projections being engaged in the generator tubes. The probe guide means is then located in front of another generator tube which can then be checked. The stepping motor is then started, this enabling the carriage to be moved over the tube plate in a precise manner and enabling the probe guide means to be brought in front of another tube of the generator. By retracting the telescopic arm through a small distance the projections are disengaged from the tube plate, this enabling the carriage to be rotated with the aid of the arm in order to move the projections and the probe guide means into a different direction. After returning the carriage into contact with the tube plate, the tubes lying in this direction can be checked.

As the carriage drive motor is a stepping motor, the carriage movements can be recorded, and thorough knowledge can be had of the tube being checked at any moment.

The stepping motor can be an electric, pneumatic or hydraulic motor, which drives the carriage by way of a transmission.

BRIEF DESCRIPTION OF THE DRAWING

One embodiment of apparatus according to the invention will now be described, by way of example only, with reference to the accompanying diagrammatic drawing, in which.

SPECIFIC DESCRIPTION

Figure 1:
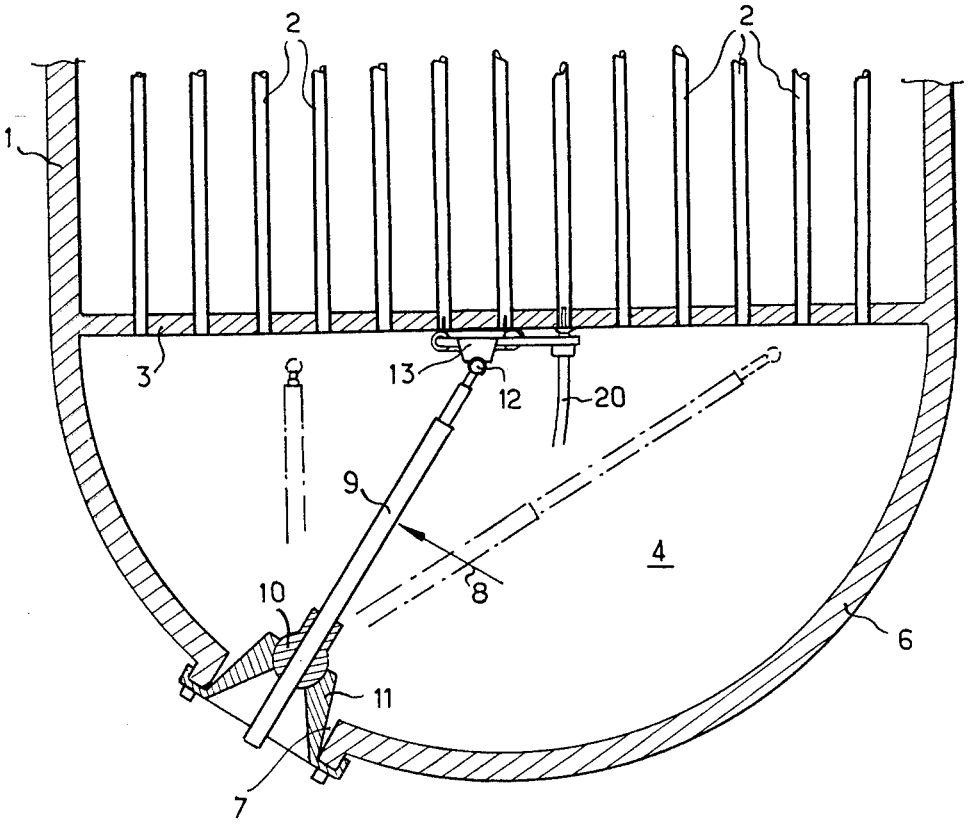
FIG. 1 is a section through the bottom part of a steam generator, showing the probe-holding apparatus in the generator.
Figure 2:
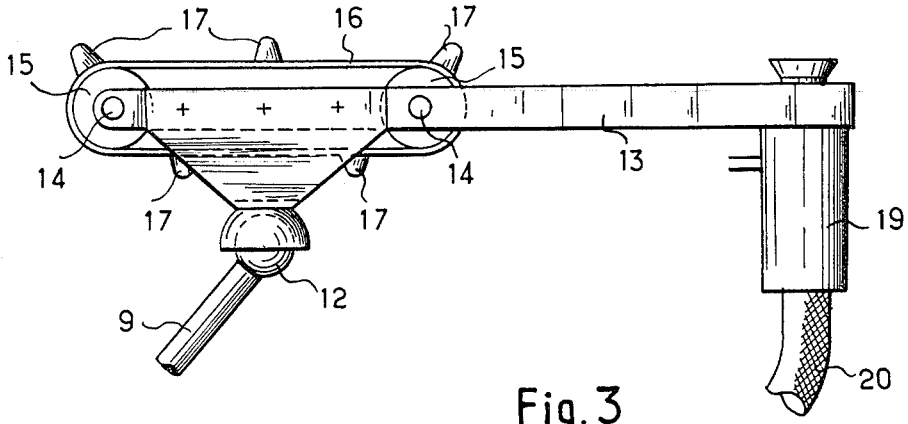
FIG. 2 is an elevational view of the apparatus.
Figure 3:
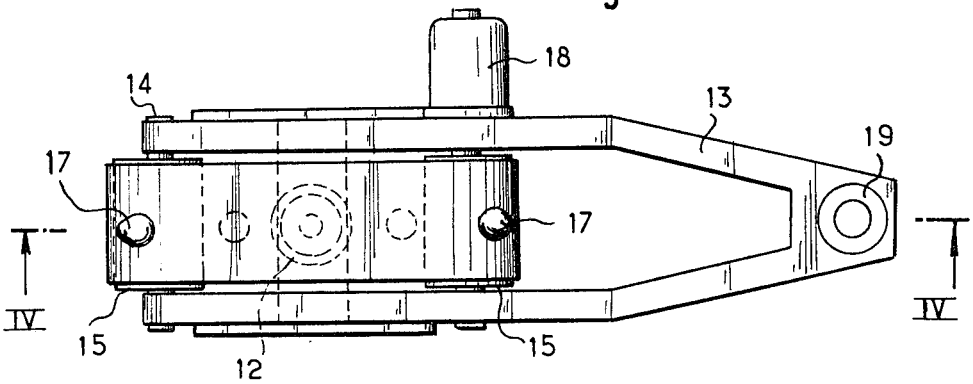
FIG. 3 is a plan view thereof.
Figure 4:
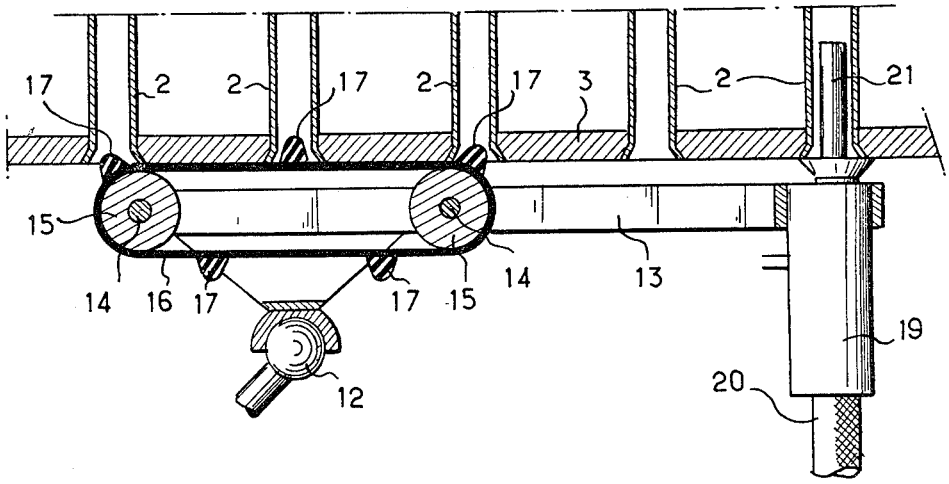
FIG. 4 is a section showing the apparatus in place of the steam generator.

In the drawing, the reference numeral 1 indicates a vertical steam generator traversed by water tubes 2, the ends of which are fixed to tube plates, the lower tube plate being represented by 3. At each of their ends, the tubes 2 open into chambers, the lower chamber of which is shown by the reference numeral 4. The chamber 4 is bounded by a dome 6 provided with an access aperture 7 which is normally closed in a sealed manner.

A probe-holding apparatus, shown on the drawing in a general manner by the reference numeral 8, is disposed in the chamber 4.

The probe-holding apparatus 8 comprises a telescopic support arm 9 biased by resilient means towards its maximum extended position and controlled by a pneumatic cylinder. One of the ends of the arm is fixed into a ball and socket joint 10, or other equivalent linkage, mounted by way of adjustable friction elements, not shown, in a cap 11 which can be fixed into the aperture 7 or can be fixed in the vicinity of the aperture.

The other end of the support arm 9 is connected by a ball and socket joint 12 to a carriage 13. Two shafts 14 spaced apart from each other and on which grooved or toothed drums 15 are fixed, are rotatably mounted in the carriage 13. A belt 16, the inner face of which is grooved or toothed, passes over the two drums 15. The belt 16 carries fingers 17 or other projections which are disposed in the longitudinal central plane of the carriage and spaced apart from each other by a distance equal to the distance between two adjacent tubes 2 or to a multiple of this distance. The output shaft of a stepping motor 18 mounted on the carriage 13 is connected to one of the shafts 14, and thus enables the belt 16 to be moved.

One of the ends of the carriage 16 carries a support 19 having its axis perpendicular to the plane of the carriage, and into which there is fixed a guide sheath 20, in which a Foucault current probe 21 slides together with its connection cable. The support 19 is likewise disposed in the longitudinal central plane of the carriage, and acts as guide means for the probe.

A locking finger, not shown, enables the ball and socket joint 12 to be put out of action, i.e. to make the carriage 13 and the telescopic arm 9 rigid with each other in the position in which these elements lie at the moment.

In order to use the probe-holding apparatus 8, the telescopic arm 9 is elongated in the direction of the tubes 2 to be examined, such that the support 13 comes into proximity with the tube plate 3, and the arm 9 is moved so as to engage the fingers 17 in the steam generator tubes 2. The probe 21 can then be inserted into a tube 2, and this tube examined.

Having carried out this examination, the probe 21 is withdrawn, and the motor 18 is started while maintaining the tube 9 in its elongated position, so that the belt 16 remains in contact with the plate 3. The carriage moves over the plate, and the support 19 comes in front of a new tube 2, and this enables this latter to be inspected. This procedure can thus be carried out successively in order to check all the tubes 2 which lie in the longitudinal direction of the carriage.

The tubes 2 are generally disposed along two different directions, mostly perpendicular to each other. It is therefore necessary to change the direction of movement of the carriage 13 in order to inspect all the tubes. In order to do this, after moving the locking finger for the ball and socket joint 12 into its locking position, the arm 9 is slightly retracted in order to disengage the fingers 17 from the openings of the tubes 10 in which they are engaged, and to disengage the probe-holding guide, the arm 9 remaining in its axial position by the action of the friction exerted on the ball and socket joint 10. The arm 9 is rotated about its axis through the required angle, the arm 9 is again extended so that the carriage 13 abuts against the plate 3, and the ball and socket joint 12 is released. The carriage 13 can thus be moved into contact with the plate 3, and the fingers 17 become engaged in the openings of the tubes 2 which lie along the second direction of the tube bundle. This operation is preferably carried out after previously moving the arm 9 into a position in which it is perpendicular to the tube plate 3. It is then necessary only to rotate this arm about its axis through an angle equal to that between the two tube directions, for example 90° if the tubes are positioned along two perpendicular directions.

It can be seen from the aforegoing description that with the aid of the apparatus, all the tubes 2 of the steam generator can easily be inspected, even those which lie at the periphery of the bundle.

The apparatus can be used for any tube spacing. For this, it is necessary only to change the distance between the fingers 17 or replace the belt 16 by a belt carrying fingers which are at a suitable distance apart, and then to move the support 19 longitudinally.

We claim:

1. A probe-holding apparatus for a probe for checking steam generator tubes, said apparatus comprising a telescopic arm resiliently urged towards its position of maximum extension and said arm having first and second opposed ends, a support, first ball-joint means movably mounting the first end of the arm on the support, a carriage, and second ball-joint means mounting said carriage on said second end of said arm, said carriage comprising an endless belt formed with projections spaced apart in accordance with spacing of said tubes, guide means for a probe, and a stepping motor for driving said belt, the guide means for the probe and the projections being disposed in the same direction.

2. Apparatus according to claim 1, wherein the projections are spaced by a distance equal to the pitch of the generator tubes.

3. Apparatus according to claim 1, wherein the projections are spaced by a multiple of the pitch of the generator tubes.

4. A probe-holding apparatus for a probe for checking steam generator tubes, said apparatus comprising a telescopic arm having first and second opposed ends, support means, said first end being pivotally mounted on the support means, and a carriage mounted on the second of said ends, said carriage comprising guide means for the probe, an endless drive member, an array of projections spaced along the drive member in the direction of drive and engageable in the ends of the tubes, and stepping motor means for driving the drive member.

5. Apparatus according to claim 4, wherein the driven member comprises an endless belt.

* * * * *